United States Patent [19]

Forssén

[11] Patent Number: 4,916,832

[45] Date of Patent: Apr. 17, 1990

[54] DEVICE FOR REVERSING AN AIR FLOW IN A DRYING CHAMBER

[75] Inventor: Gustav Forssén, Skellefteå, Sweden

[73] Assignee: Utec S.M. AB, Skelleftea, Sweden

[21] Appl. No.: 319,082

[22] PCT Filed: Aug. 24, 1987

[86] PCT No.: PCT/SE87/00371

§ 371 Date: Feb. 21, 1989

§ 102(e) Date: Feb. 21, 1989

[87] PCT Pub. No.: WO88/01718

PCT Pub. Date: Mar. 10, 1988

[30] Foreign Application Priority Data

Sep. 4, 1986 [SE] Sweden ..... 8603714

[51] Int. Cl.[4] ..... F26B 21/06

[52] U.S. Cl. ..... 34/191; 34/222; 34/231; 415/127

[58] Field of Search ..... 34/191, 222, 229, 201, 34/231; 415/126, 127, 128

[56] References Cited

U.S. PATENT DOCUMENTS 2,055,073 9/1936 Ferre .
3,065,553 11/1962 Olin .
3,477,139 11/1969 Hildebrand ..... 34/191

FOREIGN PATENT DOCUMENTS 260605 10/1928 Italy ..... 34/229

*Primary Examiner*—Henry A. Bennet
*Assistant Examiner*—John Sollecito
*Attorney, Agent, or Firm*—Cushman, Darby & Cushman

[57] ABSTRACT

Device for reversing an air flow in a drying chamber in which the air flow is created by at least one blower. A drum, rotatable about its longitudinal shaft is arranged about the blower or blowers. The drum has apertures on its casing surface to provide an air flow through the drum. The drum extends from the floor of the drying chamber to its roof, or is sealed in another way at its ends. By rotating the drum about its longitudinal shaft between two different positions, a reversal of the direction of the air flow in the drying chamber is achieved in a very simple way, although the blower is stationary and drives the air continuously in the same direction. A heat battery is arranged on the intake side of the blower.

7 Claims, 3 Drawing Sheets

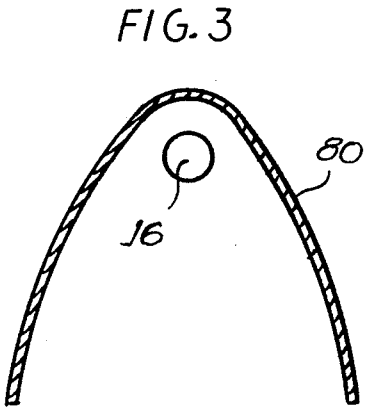
FIG. 3
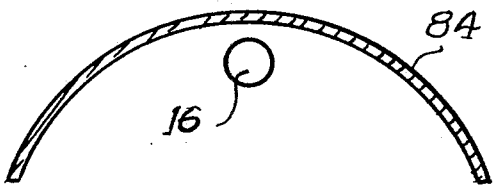
FIG. 4
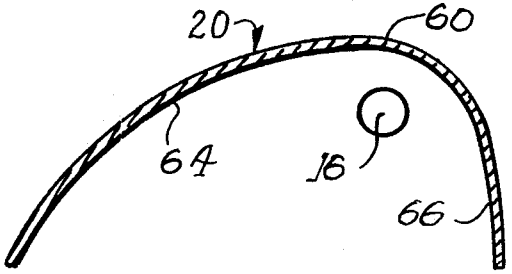
FIG. 5
FIG. 3A
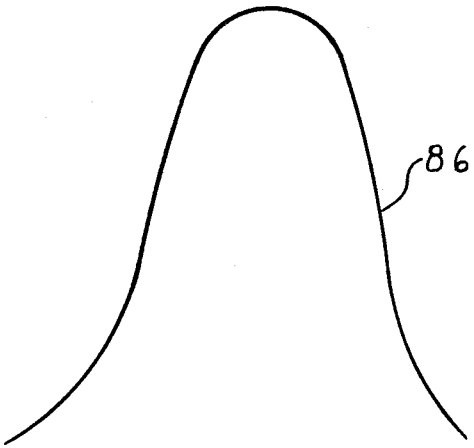
FIG. 4A
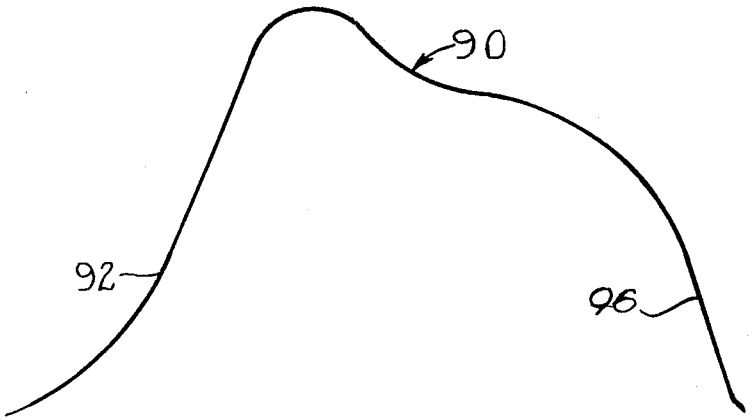
FIG. 5A

DEVICE FOR REVERSING AN AIR FLOW IN A DRYING CHAMBER

BACKGROUND OF THE INVENTION

This invention relates to a device for reversing an air flow in a drying chamber where the air flow is created by at least one blower.

In drying chambers for e.g. drying of wood there is a need of reversing the direction of the air flow in the drying chamber during a drying process. A reversal of the direction of the air flow is desired in order to obtain a continuous and rapid drying of the wood.

As a rule, the air flow is created by means of one or more blowers and the circulating air is normally heated by means of a heating device of some type, e.g. one or more so-called heating batteries. According to known technology the reversal of the air flow is effected for instance by turning the blowers so that these operate in different directions in dependence on the desired air flow direction. The blowers can be mounted on a common support frame which is then arranged rotatably. It is also previously known to change the air flow direction by adjusting a number of dampers or doors arranged at one or more stationary blowers.

SUMMARY OF THE INVENTION

It is the object of this invention to provide a device for reversing the air flow, this device being very reliable and, moreover, having a very simple structure.

The blower or blowers can be designed for one single direction of rotation or working direction by means of the inventive device, resulting in that the blower can be made more efficient simultaneously as no reversal is necessary with accompanying recurrent restarts of the driving motor of the blower. Moreover, the reversal of the air direction by means of the inventive device is very soft which is also advantageous. Furthermore, there is a great freedom of choosing the position of heat batteries about the blowers as the latter are stationary. Also, there are no difficulties in drawing the required connection lines to the heat batteries and blower motors.

BRIEF DESCRIPTION OF THE DRAWING

Illustrative examples of the invention will be described below with reference to the appended drawings, wherein:

FIG. 3 shows a section of the inventive device taken along the line III—III according to FIG. 2, and FIGS. 4 and 5 show schematically the inventive device in its two different working positions.

DETAILED DESCRIPTION

Figure 1:
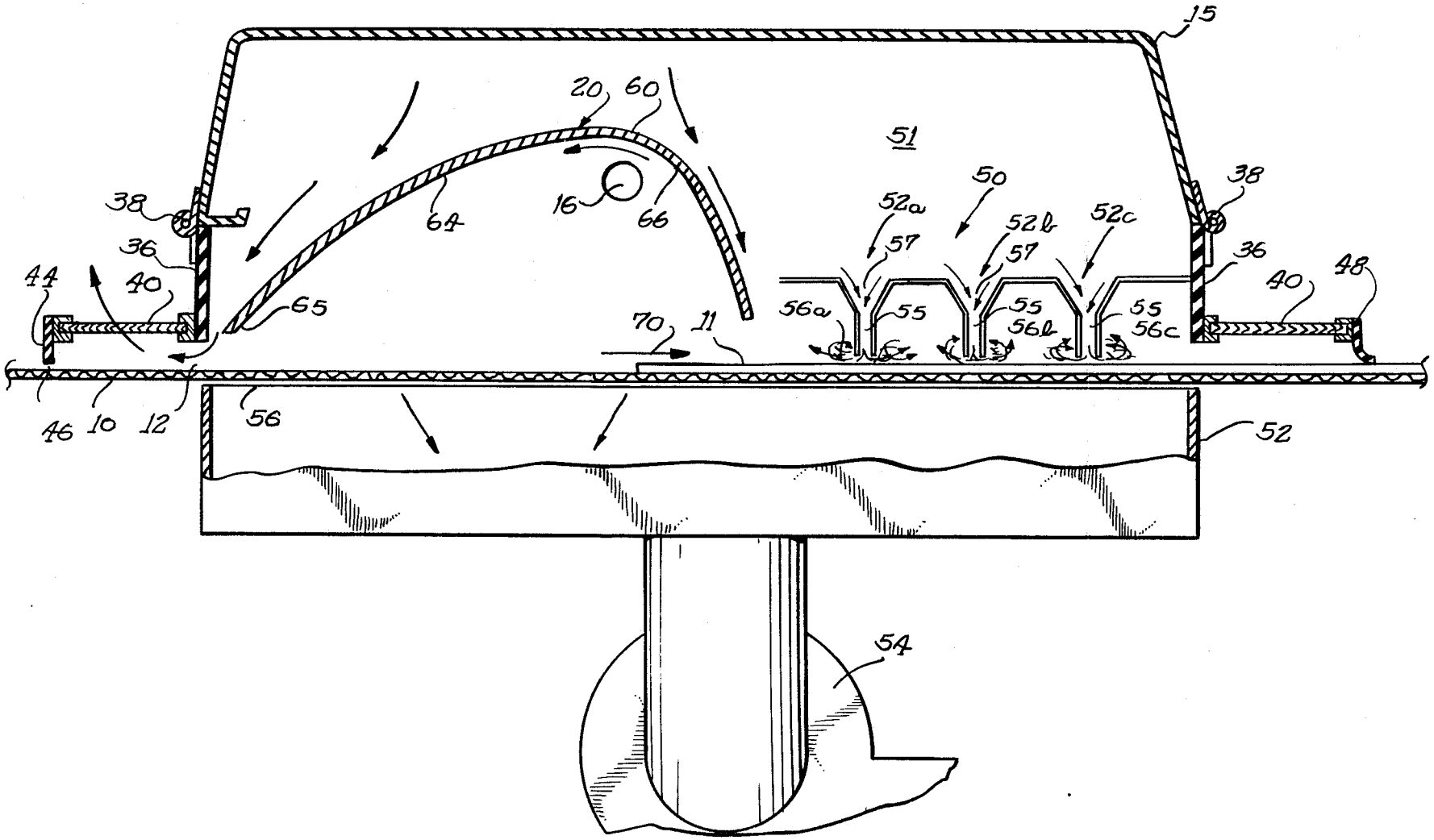
FIG. 1 shows a horizontal section of a drying chamber provided with an inventive device.
Figure 2:
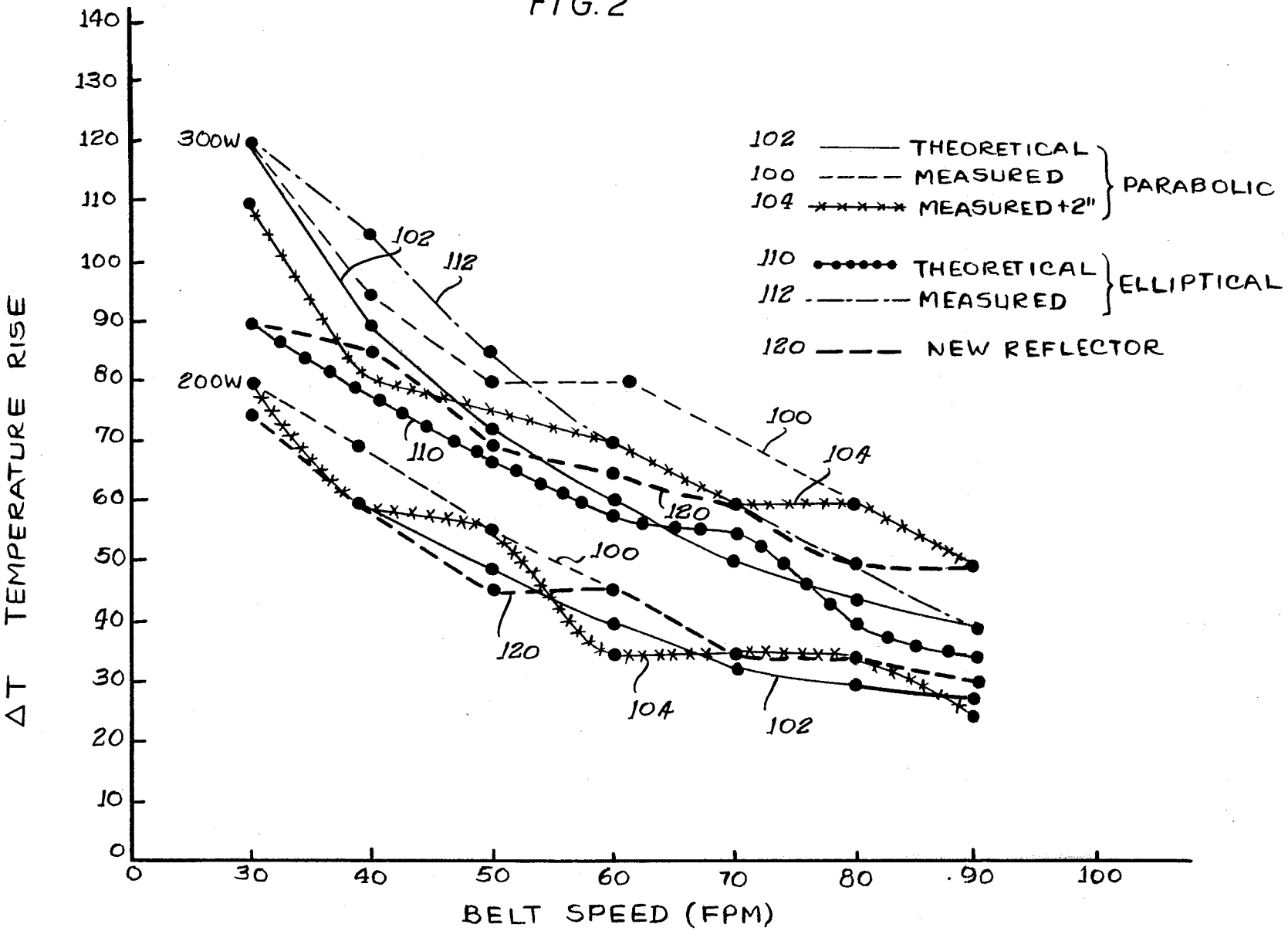
FIG. 2 shows a vertical section of a part of the drying chamber.

FIG. 1 shows a drying chamber with four walls 1–4 and an aperture 5 provided with a door. Within the drying chamber there is a wall 6 extending between the floor 7 and roof 8 of the drying chamber and defining in this way a passage 9 from the part of the drying chamber where the wood to be dried is placed. In FIG. 1 four piles of wood 10 are shown as an example thereof.

A plurality of stationary blowers 20 is arranged in the passage 9 which preferably consist of axial fans operated by electric motors (not shown). A so-called heat battery 21 fed by hot water (not shown) is arranged close to the blowers 20, the object of which is to heat the air circulating in the drying chamber. The heat battery 21 is arranged on the suction side of the blowers 20. Moreover, shields 22 for air control are arranged at the blowers 20. According to the invention a rotatable cylinder/drum 23, for instance made of a relatively thin sheet, is disposed about the stationary blower-heat battery device. The drum 23 is arranged to be rotatable about its longitudinal shaft 24. The drum 23 is provided with apertures 25, 26 in its casing surface which apertures provide an air flow through the drum. Sealing shields 27 are disposed between the heat battery 21 and the drum 23 which are intended to prevent an undesired air leakage.

A roof shield 29 is connected with the heat battery 21, the object of which is to seal the upper end of the drum 23. Similarly, it is also possible to arrange a floor shield connected with the heat battery 21 and sealing the lowermost end of the drum 23, but in many cases it is as suitable to use the floor 7 of the drying chamber or a frame arranged on the floor for this purpose. A shield 30 sealing between the heat battery 21 and the floor 7 may then be required.

In order to achieve the rotational ability of the drum 23 about the rotary shaft 24, the drum 23 is preferably provided with a plurality of wheels 32. A plurality of guide rolls 33 is arranged on the wall 2 and a plurality of guide rolls 34 is arranged on the wall 6 as well, which wheels and guide rolls are intended to facilitate rotation of the drum. In order to obtain this turning or rotation, an electric motor (not shown) is, for instance, arranged which can rotate the drum 23 in a desired direction via a mechanical gear and a chain drive 40 by way of a chain 41 connected with the drum 23. The rotational drive of the drum 23 can, of course, be arranged in a plurality of different manners and the arrangement just mentioned is only an example thereof. Other possible alternatives can be a belt drive, gear drive or friction drive. Moreover, the wheels 32 and the guide rolls 33 and 34 can, of course, be arranged in another way than that shown here.

By rotating the drum 23 so that it enters the turning position shown in FIGS. 1, 3 and 4, the blowers 20 will drive the air flow in the drying chamber in the direction shown by the arrows A, the aperture 25 serving as intake aperture and the aperture 26 as blow-out aperture.

The air flow in the drying chamber can be reversed very simply by rotating the drum 23 so that the apertures 25 and 26 are moved $\frac{1}{4}$ of a revolution, to the position shown in FIG. 5. The blowers 20 having the same direction of rotation all the time will then drive the air flow in the direction shown by the arrows B.

It will be appreciated from the above that it is very easy to reverse the air flow direction in the drying chamber whenever desired by means of the inventive device. The device of the invention can be used irrespective of the number of blowers and heat batteries used.

Of course it is also possible to provide the drum with one or two end sections if this is necessary with respect to the surroundings of the drum.

The drum apertures 25 and 26 can, of course, be divided into a suitable number of smaller apertures to impart an increased stability to the drum, if required.

The blower 20 can, of course, also comprise a so-called radial fan if this should be found to be suitable.

Moreover, the control and bearing of the drum 23 can, of course, be designed in several different ways in addition to that shown here.

In order to make the placement of the drum in the drying chamber easier, it may be suitable for practical reasons to design the drum in a plurality of parts that are assembled when the drum is installed.

Of course, it should also be realized that the device of the invention is not restricted to drying chambers for wood, but it can naturally be used in all types of drying chambers where reversal of the direction of the air flow is desirable.

Thus, the invention is not restricted to what has been shown and described above, but amendments and modifications thereof are possible within the scope of the appended claims.

What is claimed is:

1. A device for reversing air flow direction in a drying chamber which includes a floor, a roof, perimetrical sidewalls, and an internal wall extending from the floor to the roof but including two horizontally spaced openings for permitting air circulation in a horizontal circuit around the internal wall in the drying chamber, said device comprising:

at least one blower having fan means mounted on at least one rotary shaft to rotate therewith, which shaft is mounted for rotation about a horizontal axis, and which, when rotating, provides said blower with a suction side and a pressure side with regard to an annular shield which surrounds each blower; each said blower being disposed between said internal wall, between said two openings therethrough, and one said perimetrical sidewall;

a vertically-oriented drum enclosing each said blower and having a vertically-extending longitudinal axis;

means defining at least two types of openings horizontally through said drum, these two types of openings being spaced substantially from one another around said drum;

said drum extending, widthwise thereof, generally from said internal wall to said one perimetrical sidewall and from near said floor to near said roof, so that most air circulating horizontally about said internal wall must pass through one of said two types of openings, into said drum, past said at least one blower, and out of said drum through the other of said two types of openings; and means mounting said drum for rotation about said vertically-extending longitudinal axis between a first position in which one said type of opening thereof is associated with said suction side of said at least one blower and the other said type of opening thereof is associated with said pressure side of said at least one blower, so that operation of said at least one blower establishes and maintains a horizontal air flow circulation pattern in one direction around said chamber, and a second position in which the other said type of opening of said drum is associated with said suction side of said at least one blower and the one said type of opening of said drum is associated with said pressure side of said at least one blower, so that operation of said at least one blower establishes and maintains a horizontal air flow circulation pattern in a direction opposite to said one direction around said chamber.

2. The device of claim 1, wherein:

each said blower is an axial-type blower.

3. The device of claim 1, wherein:

said one type and other type of said openings through said drum comprise two openings located generally diametrically opposite one another on said drum.

4. The device of claim 1, wherein:

said drum mounting means comprise wheels supporting said drum from said floor.

5. The device of claim 1, further including:

means for selectively rotating said drum about said vertically-extending longitudinal axis between said first and second positions thereof.

6. The device of claim 1, further comprising:

an air heater associated with said suction side of said at least one blower for heating air circulating through said drum as said at least one blower is operating.

7. The device of claim 1, wherein:

said first and second positions of said drum are located about one-quarter of a revolution of said drum from one another.

* * * * *